US006684786B2

(12) United States Patent
Nagata et al.

(10) Patent No.: US 6,684,786 B2
(45) Date of Patent: Feb. 3, 2004

(54) PRESS PLATE MOUNTING APPARATUS

(75) Inventors: Kazuo Nagata, Tokyo (JP); Katsuhide Tsukamoto, Tokyo (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 10/277,958

(22) Filed: Oct. 23, 2002

(65) Prior Publication Data

US 2003/0079634 A1 May 1, 2003

(30) Foreign Application Priority Data

Nov. 1, 2001 (JP) ..... 2001-336282

(51) Int. Cl.[7] ..... B41F 27/00

(52) U.S. Cl. ..... 101/481; 101/486; 101/477; 101/DIG. 36; 33/618

(58) Field of Search ..... 101/479, 480, 101/481, 485, 486, DIG. 36, 477, 415.1, 389.1; 33/614, 617, 618, 619, 620, 621

(56) References Cited

U.S. PATENT DOCUMENTS 2,984,910 A * 5/1961 Cour ..... 33/618
3,550,283 A * 12/1970 Bernardi et al. ..... 33/618
4,449,452 A * 5/1984 Mansell ..... 101/389.1
4,925,506 A * 5/1990 Baker ..... 156/64

FOREIGN PATENT DOCUMENTS

DE 89 12 428 2/1991
EP 1 308 277 A1 * 5/2003

* cited by examiner

*Primary Examiner*—Leslie J. Evanisko
(74) *Attorney, Agent, or Firm*—Lowe Hauptman Gilman & Berner LLP

(57) ABSTRACT

A press plate mounting apparatus has a press plate placement portion capable of holding a press plate having a partially formed print face region, and a plate cylinder holding portion that rotatably holds a plate cylinder onto which the press plate is mounted. Positioning cross marks are provided in a non-print region of the press plate. The press plate placement portion includes a suction surface that sucks the print face region, and a scale member provided at a position outward of the suction surface and extending in a predetermined direction. The scale member is able to contact the locating cross marks when the press plate is held at a predetermined position. The scale member has a scale that makes it possible to visually check a positional deviation of the press plate in the predetermined direction.

3 Claims, 7 Drawing Sheets

PRESS PLATE MOUNTING APPARATUS

BACKGROUND OF THE INVENTION

1. Field of the Invention

The invention relates to a press plate mounting apparatus and, more particularly, to a press plate mounting apparatus capable of mounting a press plate easily and accurately onto an outer peripheral surface of a plate cylinder.

2. Description of the Related Art

A generally cylindrical plate cylinder of a rotary press is designed so that a sheet-shaped press plate having a print face region with projections and depressions can be mounted onto an outer peripheral surface of the plate cylinder. The plate cylinder mounting operation is performed manually in many cases.

In such a case, however, it is not easy to accurately mount a sheet-like press plate onto the outer peripheral surface of a cylindrical plate cylinder. That is, there is a drawback that a press plate is likely to have a positional deviation from a precise position on the outer peripheral surface of the plate cylinder in the directions of an axis or the circumferential directions when mounted on the outer peripheral surface of the plate cylinder.

SUMMARY OF THE INVENTION

The invention has been accomplished in view of the aforementioned drawback. It is an object of the invention to provide a press plate mounting apparatus capable of mounting a press plate easily and accurately onto an outer peripheral surface of a plate cylinder.

In order to achieve the aforementioned object, the invention adopts a construction as follows. That is, the press plate mounting apparatus of the invention includes a press plate placement portion capable of holding a press plate having a partially formed print face region, and a plate cylinder holding portion that rotatably holds a plate cylinder onto which the press plate is mounted. The apparatus mounts the press plate onto an outer peripheral surface of the plate cylinder by rotating the plate cylinder while causing the press plate to contact the outer peripheral surface of the plate cylinder. A protrusion is provided in a non-print region of the press plate. The press plate placement portion includes a suction surface that sucks the print face region, and a positioning member provided at a position outward of the suction surface and extending in a predetermined direction. The positioning member is able to contact the protrusion when the press plate is held at a predetermined position. The positioning member has a scale that makes it possible to visually check a positional deviation of the press plate in the predetermined direction. According to this construction, when the press plate is set on the press plate placement portion, the positioning of the press plate in the direction perpendicular to the aforementioned predetermined direction can be easily accomplished by causing the protrusion of the press plate to contact the positioning member. Furthermore, using the scale, the positioning of the press plate in the predetermined direction can also be easily accomplished. Therefore, the press plate can be reliably held on the press plate placement portion without a positional deviation in the directions of the plane. While this state is maintained, the plate cylinder is rotated with the press plate contacting the outer peripheral surface of the plate cylinder. In this manner, the press plate can be easily and precisely mounted on the outer peripheral surface of the plate cylinder.

In the invention, it is possible to adopt a construction in which the press plate placement portion is provided rotatably about an end portion of the press plate placement portion located toward the plate cylinder holding portion, and allows the press plate to be set on the press plate placement portion with the suction surface facing upward. This construction further facilitates the setting of the press plate onto the press plate placement portion.

It is also possible to adopt a construction in which the press plate placement portion is provided with a floatation restricting member capable of restricting separation of the print face region from the suction surface. This construction makes it possible to prevent separation of the press plate from the press plate placement portion when the press plate placement portion is turned.

In this specification, the term "normal position of the press plate placement portion" means a setting position of the press plate on the press plate placement portion which makes it possible to precisely mount the press plate in the circumferential directions of the outer peripheral surface of the plate cylinder and the directions of an axis thereof.

DETAILED DESCRIPTION OF PREFERRED EMBODIMENTS

Preferred embodiments of the invention will be described hereinafter with reference to the accompanying drawings.

Figure 1:
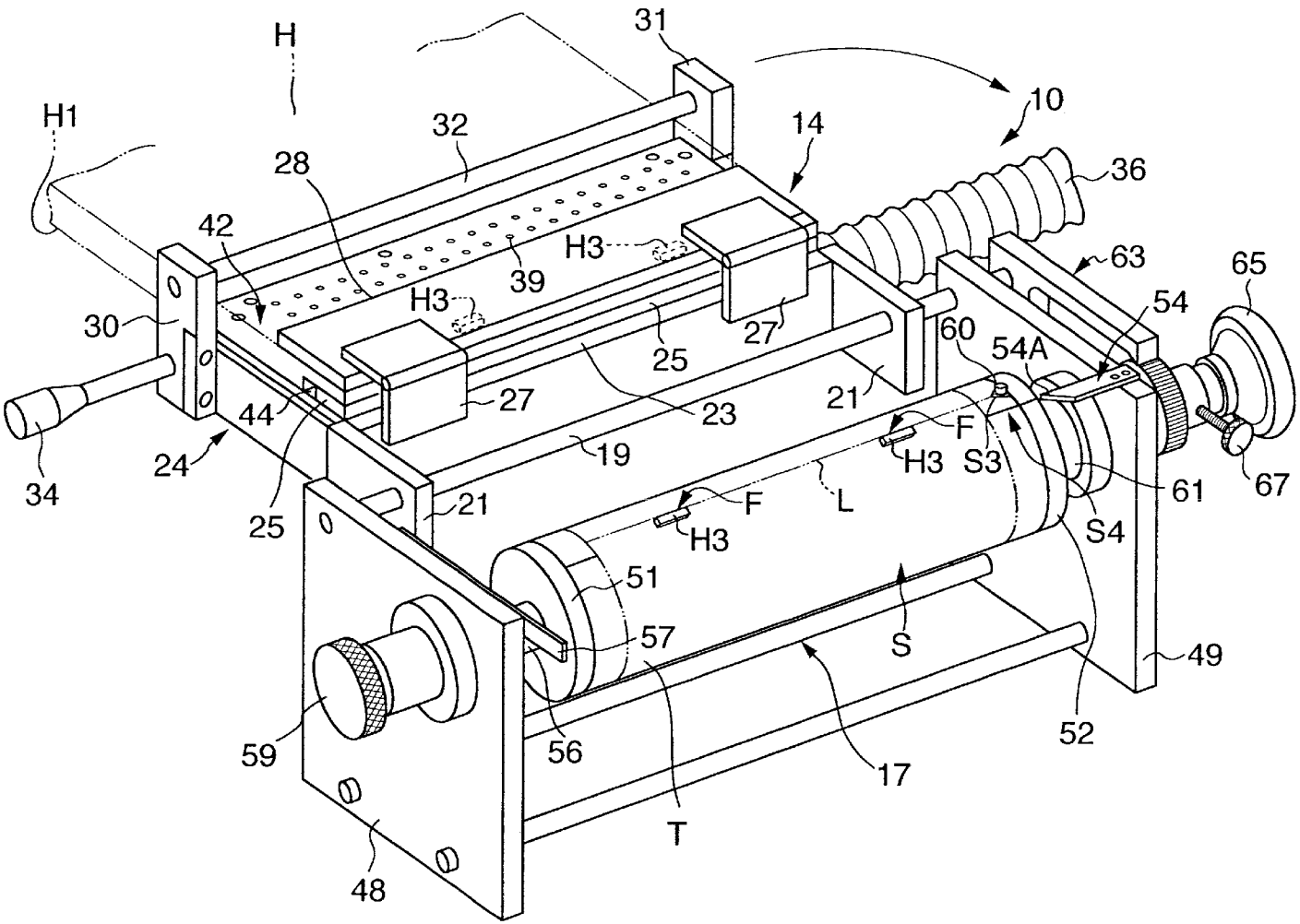
FIG. 1 is a schematic perspective view of a press plate mounting apparatus in accordance with an embodiment of the invention in a state.
Figure 2:
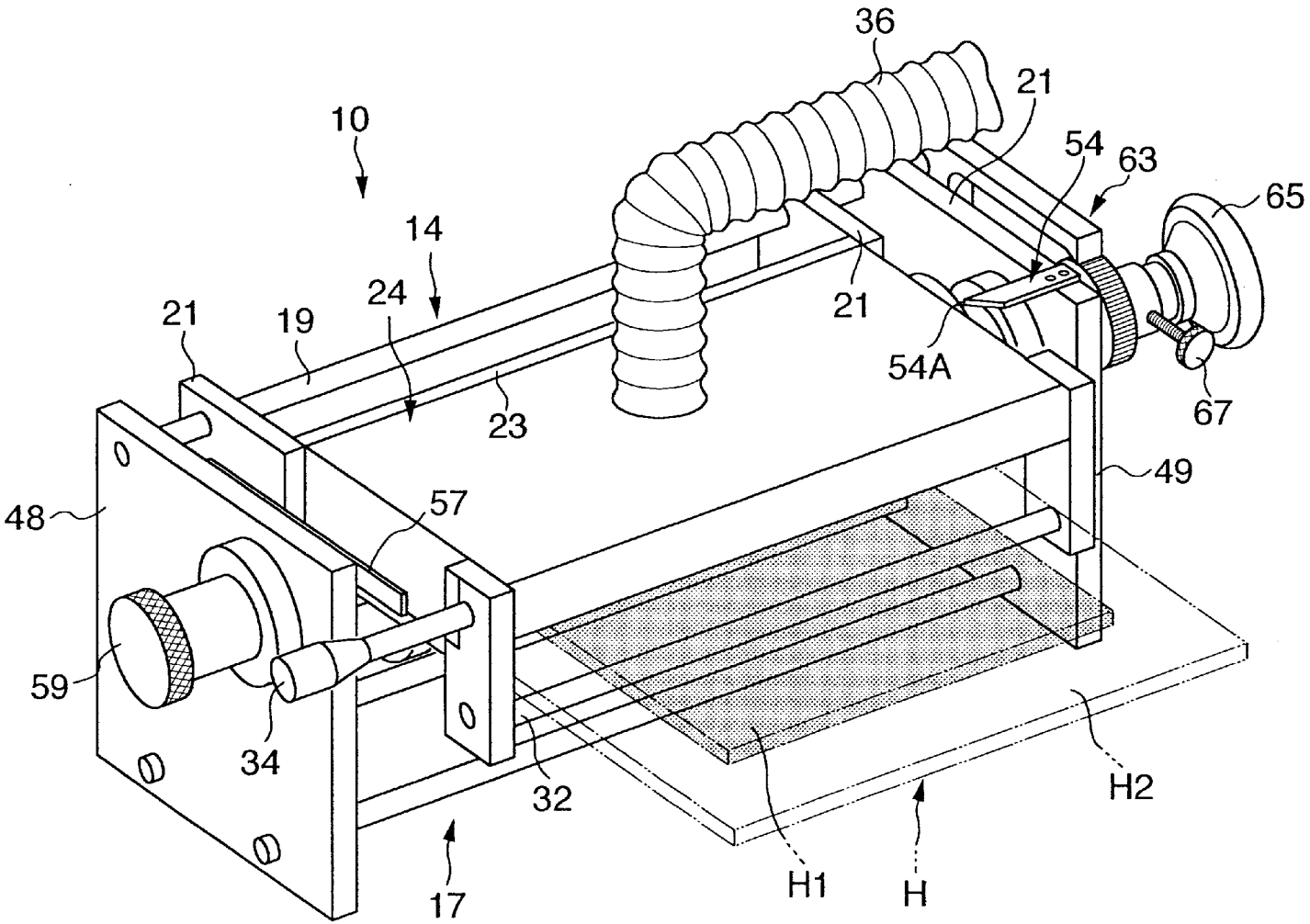
FIG. 2 is a schematic perspective view of the press plate mounting apparatus in another state.
Figure 3:
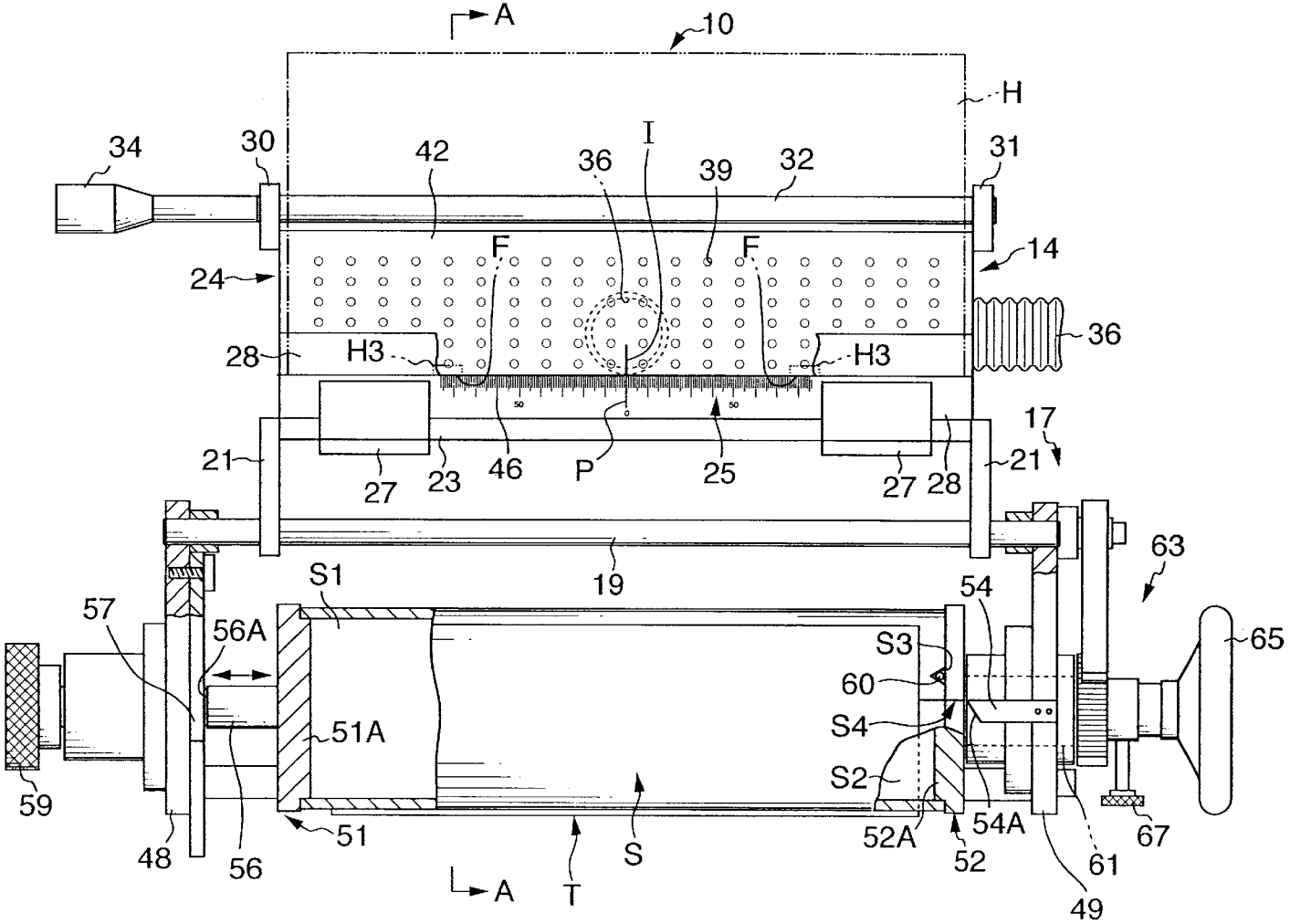
FIG. 3 is a schematic plan view of the press plate mounting apparatus shown in FIG. 1.
Figure 4:
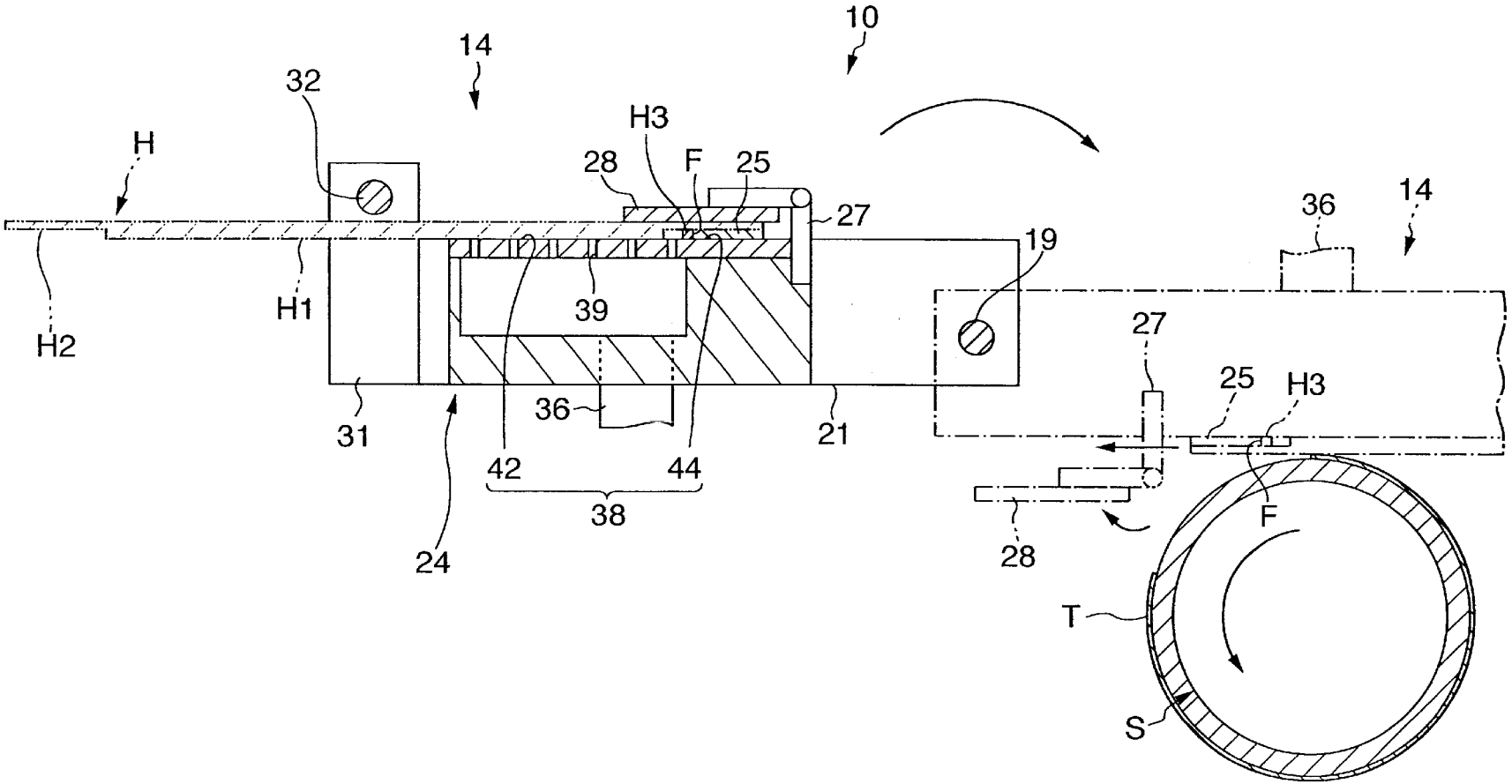
FIG. 4 is a sectional view of the press plate mounting apparatus taken on line A—A in FIG. 3, where a portion of the apparatus shown in FIG. 3 is omitted.

FIG. 1 is a schematic perspective view of a press plate mounting apparatus 10 in accordance with the invention in a state. FIG. 2 is a schematic perspective view of the press plate mounting apparatus 10 in another state. FIG. 3 is a schematic plan view of the press plate mounting apparatus 10 shown in FIG. 1. FIG. 4 is a sectional view of the press plate mounting apparatus 10 taken on line A—A in FIG. 3, where a portion of the apparatus shown in FIG. 3 is omitted. The press plate mounting apparatus 10 shown in these drawings is an apparatus for mounting a press plate H onto an outer peripheral surface of a plate cylinder S that has been removed from a printing apparatus of a printing machine (not shown). The press plate mounting apparatus 10 has a press plate placement portion 14 for holding the press plate H, and a plate cylinder holding portion 17 for holding the plate cylinder S.

The plate cylinder S, in a form that is merely illustrative and not restrictive, has a generally cylindrical shape that has opening portions S1, S2 at two opposite ends thereof in the direction of an axis (left-right both end sides in FIG. 3) as shown in FIG. 3. The opening portion S2 on the right side in FIG. 3 has a generally "V"-shaped engaging groove S3 that has been cut out so as to extend toward the opening portion S1 on the left side in FIG. 3. An outer peripheral surface of the plate cylinder S is incised with a reference line S4 that extends in the direction of the axis (left-right direction in FIG. 3) from a position that is a predetermined distance apart from the engaging groove S3 in the circumferential direction.

Figure 5:
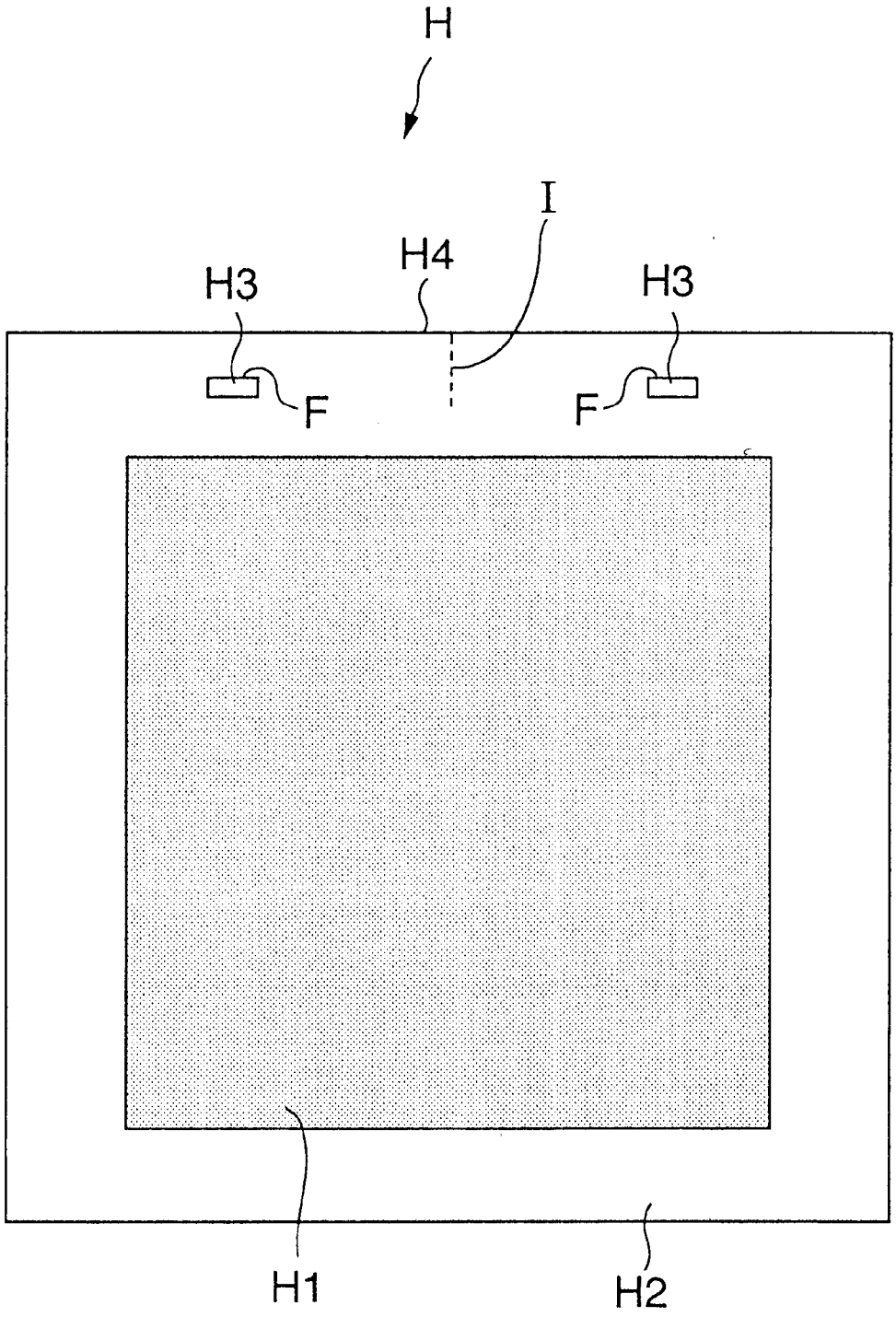
FIG. 5 is a schematic plan view of a press plate used by the press plate mounting apparatus.
Figure 7:
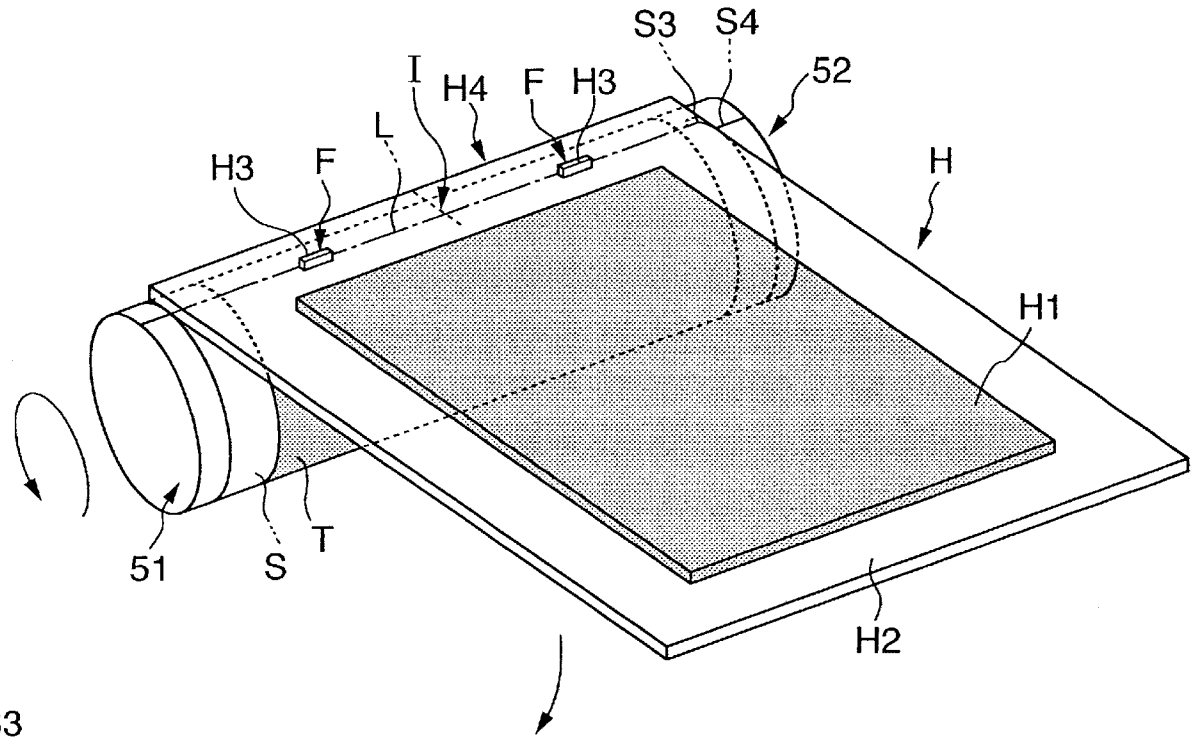
FIG. 7(A) is a schematic perspective view illustrating a state where a portion of the press plate has just been attached to a portion of the plate cylinder.
FIG. 7(B) is an enlarged partial view illustrating a state where the position of a plate cylinder engagement portion and the position of press plate cross marks are aligned.
Figure 7:
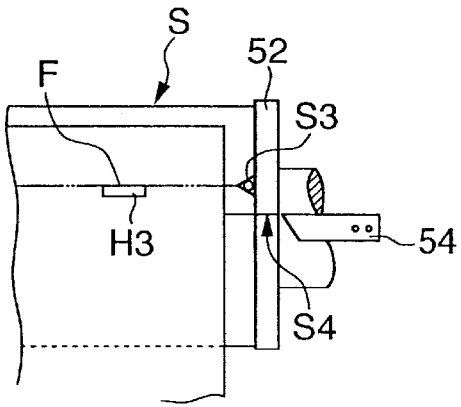

The press plate H has been formed in a generally quadrate sheet shape from, for example, a synthetic resin, such as a polyamide-base resin, a polyurethane-base resin, a polyethylene terephthalate (PET), etc. As shown in FIGS. 5 and 7, a portion of the obverse surface of the press plate H is a print face region H1 that has a generally quadrate shape in a plan view, and has projections and depressions corresponding to a predetermined print pattern. In this embodiment, an outer area surrounding the print face region H1 forms a generally smooth and flat non-print region H2 whose upper side surface is slightly withdrawn and therefore forms a recess relative to an upper side surface of the print face region H1. Two positioning cross marks H3 (protrusions) having generally the same rectangular parallelepiped shape are provided in the non-print region H2, more specifically, at upper positions in FIG. 5, and are protruded toward the obverse side. The positioning cross marks H3 are formed so that upper end surfaces thereof are substantially flush with upper end portions of the print face region H1. The positioning cross marks H3 extend along an end surface H4 of the press plate H located at an upper end in FIG. 5, and are substantially bilaterally symmetric to each other in FIG. 5. Therefore, an outside surface F,F of each positioning cross mark H3, H3 located at an upper side in FIG. 5, that is, at a far side in the direction of depth in FIG. 7, are substantially parallel to the end surface H4.

The press plate placement portion 14, as shown in FIGS. 1 to 4, is provided rotatably about a rotation shaft 19 that is located on the side of the plate cylinder holding portion 17 so that the press plate placement portion 14 can be displaced between an initial position indicated by solid lines in FIGS. 1 and 4 which is a position where the press plate placement portion 14 is set before the mounting of the press plate H, and a plate cylinder holding portion-adjacent position indicated by one-dot chain lines in FIGS. 2 and 4 which is a position where the press plate placement portion 14 is set when the press plate H is mounted.

More specifically, the press plate placement portion 14 has: a pair of connector plates 21, 21 fixed to opposite end portions of the rotation shaft 19 in the direction of an axis thereof, the rotation shaft 19 being rotatably connected to the plate cylinder holding portion 17; a transverse plate 23 extending between and fixed to rearward portions of the connector plates 21, 21 located rearward in FIG. 1; a box-shaped suction member 24 fixed to a rearward portion of the transverse plate 23 located rearward in FIG. 1; a scale member 25 provided as a positioning member and fixed to a forward upper-surface portion of the suction member 24 in FIG. 1; a cantilever-like presser member 28 connected to the transverse plate 23 via hinges 27 and extending along the scale member 25; a pair of side members 30, 31 fixed to rearward portions of the suction member 24 in FIG. 1 and extending upward in FIG. 1; a round bar-shaped floatation restricting member 32 extending between upper portions of the side members 30, 31 in FIG. 1; and a handle 34 extending outward from the side member 30.

The suction member 24 is connected with a piping 36 that extends from a vacuum pump (not shown), and therefore is able to suck the press plate H due to suction force from the vacuum pump. An upper surface of the suction member 24 in FIG. 4 forms a holding surface 38 for holding the press plate H. The holding surface 38 includes a suction surface 42 that has many suction holes 39 for sucking the print face region H1, and a smooth surface 44 which is located outward of the suction surface 42 and to which the scale member 25 is fixed. A width of the suction member 24 in the right-left direction in FIG. 4 is smaller than a width of the press plate H in the same direction, so that the press plate H is sucked and held by the suction member 24 with a leftward portion of the press plate H in FIG. 4 protruding from a left end portion of the suction member 24 in FIG. 4.

The scale member 25, as shown in FIG. 4, has a thickness that is substantially equal to the height of the positioning cross marks H3, and extends in a direction that is substantially parallel to the suction surface 42, that is, a direction perpendicular to the sheet of the drawing of FIG. 4. An obverse surface of the scale member 25 has a scale 46 as shown in FIG. 3. The scale 46 is provided so as to allow the visual checking of a positional deviation of the press plate H in the direction of extension of the scale member 25. That is, the scale 46 is formed by incising numerals and equally spaced lines on two sides of a point of origin P that is defined substantially at the middle in the direction of extension of the scale member 25 so as to indicate the distance from the origin point P. The origin point P is set so that when a center portion of the press plate H in the right-left direction in FIG. 3 (alignment mark I) is brought to face the origin point P, the positioning cross marks H3, H3 (FIGS. 3 and 7) of the press plate H are located at normal positions in the right-left direction in FIG. 3 on the press plate placement portion 14. A width of the scale member 25 in the top-bottom direction in FIG. 3 is set so that when the outer surfaces F of the positioning cross marks H3 contact an upper end surface of the scale member 25 in FIG. 3, the press plate H is positioned at a correction position on the press plate placement portion 14 in the top-bottom direction in FIG. 3.

The presser member 28 is formed by a translucent plate that is formed from vinyl chloride or the like. As shown in FIG. 4, the presser member 28 is provided so as to press and hold the reverse surface of the press plate H, that is, an upper surface thereof in FIG. 4.

The floatation restricting member 32, as shown in FIG. 4, extends slightly above the press plate H held at the normal position. The floatation restricting member 32 is provided so as to restrict separation of the print face region H1 from the suction surface 42 when the press plate placement portion 14 is inverted or turned over.

Figure 6:
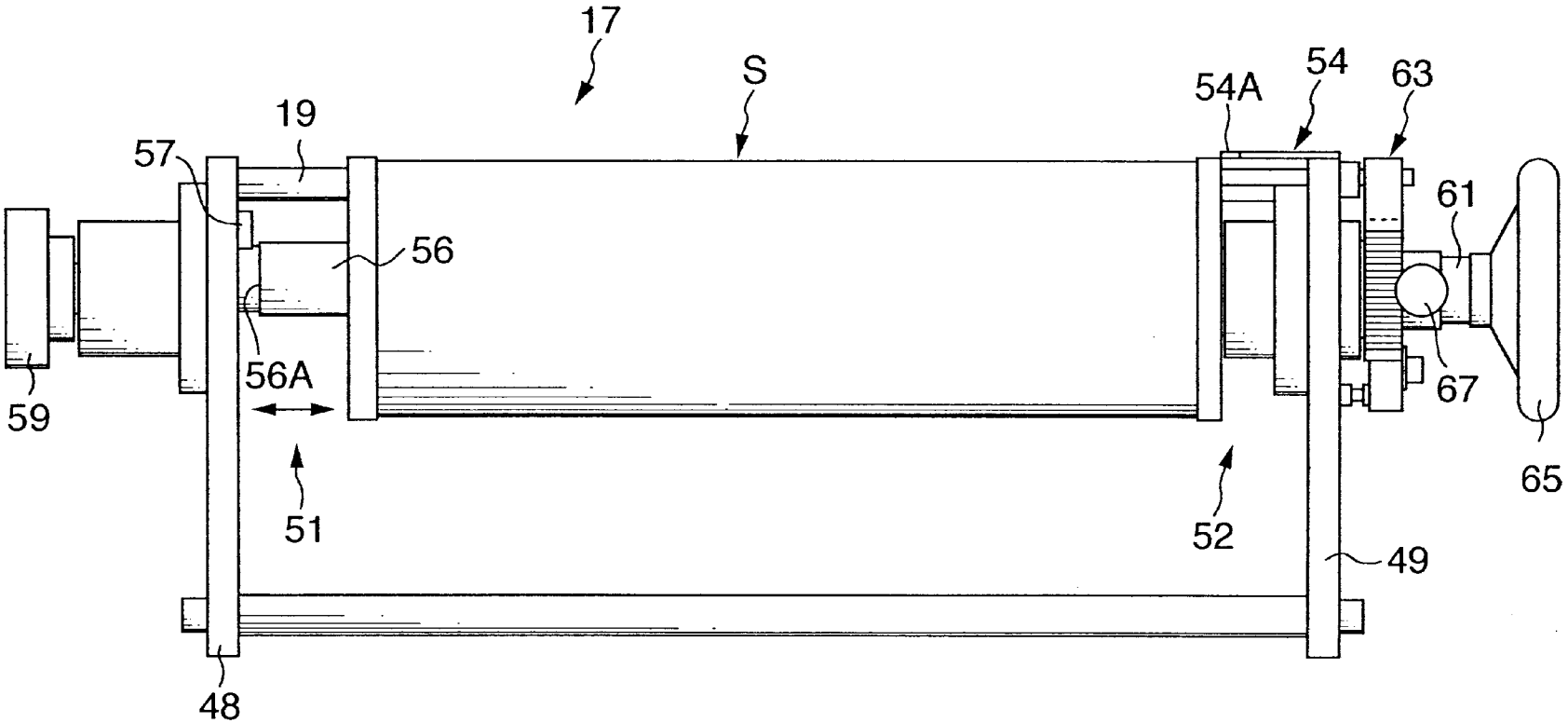
FIG. 6 is a schematic elevation of a plate cylinder holding portion.

The plate cylinder holding portion 17, as shown in FIGS. 3 and 6, has a pair of side plates 48, 49 that rotatably support the rotation shaft 19 at two end sides of the rotation shaft 19 in the direction of extension thereof, and a pair of cylinder receiving members 51, 52 that are located inwardly of the side plates 48, 49 and that are capable of clamping the plate cylinder S.

The right hand-side side plate 49 is provided with an indicator 54 for setting the reference line S4 of the plate cylinder S at a predetermined position. A distal end portion 54A of the indicator 54 has an inwardly pointed shape, and is located adjacent to the right hand-side cylinder receiving member 52.

Each of the cylinder receiving members 51, 52, as shown in FIG. 3, has on its inside a stepped portion 51A, 52A. The stepped portions 51A, 52A are insertable into the plate cylinder S from the opening portions S1, S2, and are fittable to inner peripheral portions of the plate cylinder S.

A shaft member 56 extends through the left hand-side side plate 48, and is fixed to the left hand-side cylinder receiving member 51. The shaft member 56 is provided movably in the right and left directions and rotatably relative to the side plate 48. The shaft member 56 has in its intermediate portion a groove 56A that is engageable with a stopper member 57. The stopper member 57 is provided so that the stopper member 57 can be moved apart from and can be moved closer to the shaft member 56 from above. Engagement of the groove 56A with the stopper member 57 restricts movements of the shaft member 56 in the directions of the axis. The shaft member 56 is urged outward from the side plate 48 by a spring (not shown) so that when the shaft member 56 is pushed inward, overcoming the elastic force of the spring, by holding a grip 59 provided at a left end side of the shaft member 56, the stepped portion 51A can be received in the plate cylinder S. If in this state, the stopper member 57 is engaged with the groove 56A, it becomes impossible to maintain the state where the stepped portion 51A is received in the plate cylinder S.

The stepped portion 52A of the cylinder receiving member 52 located on the right hand side is provided with a protrusion 60 that is engageable with the engaging groove S3 of the plate cylinder S. The engaging groove S3 and the protrusion 60 are engaged when the stepped portion 52A is fitted into the plate cylinder S. A shaft member 61 extending through the right hand-side side plate 49 is rotatably attached to the cylinder receiving member 52. Rotation of the shaft member 61 is restricted in a direction by a ratchet mechanism 63. Therefore, while the plate cylinder S is clamped between the cylinder receiving members 51, 52, the plate cylinder S is rotatable only in one direction due to rotation of the shat members 56, 61. A turning handle 65 for adjusting the position of the plate cylinder S is provided at a right end side of the shaft member 61. A stopper member 67 for restricting rotation of the shaft member 61 is provided partway of the shaft member 61.

Next described will be an operation of the press plate mounting apparatus 10 for mounting the press plate H.

First, the press plate H is set on the press plate placement portion 14 with the suction surface 42 facing upward as shown in FIG. 1. That is, after the presser member 28 has been withdrawn from the suction surface 42 toward the plate cylinder holding portion 17, the press plate H is held by the suction surface 42 in such a manner that the print face region H1 of the press plate H faces downward. In this operation, the outer faces F of the positioning cross marks H3 are brought into contact with the scale member 25. While this state is maintained, the position of the press plate H is adjusted so that the alignment mark I formed at a substantially center portion on the reverse side of the print face region H1 coincides with the origin point P of the scale member 25. Thus, the press plate H is positioned in the right-left direction in FIG. 3, and is sucked and held at the normal position on the press plate placement portion 14.

Before or after this operation, the plate cylinder S is removed from the printing apparatus (not shown), and a double-side sticky tape T is adhered to the outer peripheral surface of the plate cylinder S. The plate cylinder S is then clamped and held between the cylinder receiving members 51, 52, so that the plate cylinder S is held in the plate cylinder holding portion 17. More specifically, the engagement of the left-side stopper member 57 in FIG. 3 with the groove 56A is removed, and the cylinder receiving members 51, 52 are placed so that the interval therebetween is greater than the dimension of the plate cylinder S in the direction of the axis. Then, while the right-side stepped portion 52A is fitted into the right-side opening portion S2 of the plate cylinder S with the double-side sticky tape T, the protrusion 60 is engaged with the engaging groove S3 of the plate cylinder S. Furthermore, while the left-side grip 59 is pushed inward, the left-side stepped portion 51A is fitted into the left-side opening portion S1. While this state is maintained, the stopper member 57 is engaged with the groove 56A to restrict outward movement of the cylinder receiving member 51, so that the plate cylinder S is clamped between the cylinder receiving members 51, 52. After that, the turning handle 65 provided on the right hand side is turned to bring the distal end portion 54A of the indicator 54 to a position at which the distal end portion 54A faces the reference line S4 of the plate cylinder S. When this position is reached, the stopper member 67 on the right hand side is operated to prevent rotation of the plate cylinder S. The double-side sticky tape T adhered to the plate cylinder S provides an adhesion force that is greater than the suction force of the suction member 24 on the press plate H.

After the press plate H and the plate cylinder S are set as described above, the handle 34 is manually lifted and pivoted to change the press plate placement portion 14 from the initial state indicated by solid lines in FIGS. 1 and 4 to the plate cylinder holding portion-adjacent inverted state indicated by one-dot chain lines in FIGS. 2 and 4. As shown in FIGS. 1, 7(A) and 7(B), the press plate H is brought into contact with the plate cylinder S at such a position that an extension of an imaginary line L connecting the outer surfaces F of the locating cross marks H3, H3 coincides with the engaging groove S3 of the plate cylinder S. After this state is established, the restriction on the plate cylinder S by the stopper member 67 provided on the right hand side in FIG. 3 is removed, and the plate cylinder S is turned by using the turning handle 65, so that the press plate H is gradually wound on the outer peripheral surface of the plate cylinder S while shifting from a state indicated by one-dot chain lines in FIG. 4 in a direction of plane relative to the press plate placement portion 14. Thus, the press plate H is accurately attached to the outer peripheral surface of the plate cylinder S.

The position at which the distal end 54A of the indicator 54 coincides with the reference line S4 is a reference position at which an extension of the imaginary line L connecting the outer surfaces F of the locating cross marks H3 of the press plate H coincides with the engaging groove S3 of the plate cylinder S, and is a position that is used as a reference line for various print regions of the print face region H1 of the press plate H when the plate cylinder S is set in a plurality of printing apparatuses (not shown). Therefore, in printing apparatuses, a substantially consistent print start position is set.

After that, the engagement between the stopper member 57 on the left hand side in FIG. 3 and the groove 56A of the shaft member 56 is discontinued, so that the elastic force of the spring (not shown) moves the cylinder receiving members 51, 52 apart. Thus, the plate cylinder S with the press plate H mounted thereon is removed from the plate cylinder holding portion 17, and is attached to a printing apparatus (not shown) again.

Therefore, this embodiment advantageously makes it possible to precisely mount the press plate H onto the outer peripheral surface of the plate cylinder S by a relatively easy operation.

Although the foregoing embodiment adopts a construction in which the press plate placement portion 14 is brought closer to the plate cylinder holding portion 17 from above, it is also possible to adopt a construction in which the press plate placement portion 14 is brought closer to the plate cylinder holding portion 17 from below. However, the construction of the foregoing embodiment makes it easier to set the press plate H onto the press plate placement portion 14.

It is also possible to adopt a construction in which the press plate H is mounted on the outer peripheral surface of the plate cylinder S by moving the plate cylinder holding portion 17 along the press plate H when the press plate H starts contacting the outer peripheral surface of the plate cylinder S, and therefore causing the plate cylinder S to roll on the press plate H. However, the construction of the foregoing embodiment facilitates reduction of the entire size of the apparatus because the construction of the embodiment eliminates the need for a mechanism that moves the plate cylinder holding portion 17 or the like.

The constructions of various portions of the apparatus of the invention are not restricted by the constructions illustrated in the drawings, but may be modified in various manners as long as substantially equivalent operation is maintained.

As described above, the apparatus of the invention includes a positioning member capable of contacting a protrusion formed on a press plate when the press plate is held at a predetermined position. The positioning member is provided with a scale that allows the visual checking of a positional deviation of the press plate in a predetermined direction. Therefore, it becomes possible to easily and accurately mount a press plate onto an outer peripheral surface of a plate cylinder.

Furthermore, the press plate placement portion is provided rotatably about an end portion thereof located toward the plate cylinder holding portion, the press plate can be set onto the press plate placement portion with the press plate-sucking surface facing upward. Therefore, the setting of a press plate onto the press plate placement portion becomes easier.

Furthermore, the press plate placement portion is provided with the floatation restricting member capable of restricting separation of the print face region from the suction surface. Therefore, it is possible to prevent undesired separation of a press plate caused by the turning of the press plate placement portion.

What is claimed is:

1. A press plate mounting apparatus comprising:

a press plate placement portion capable of holding a press plate having a partially formed print face region;

a plate cylinder holding portion that rotatably holds a plate cylinder having an outer peripheral surface onto which the press plate is mounted by rotating the plate cylinder while causing the press plate to contact the outer peripheral surface of the plate cylinder; and a protrusion provided in a non-print region of the press plate, the press plate placement portion including:

a suction surface that sucks the print face region; and a positioning member provided at a position outward of the suction surface and extending in a predetermined direction, the positioning member being able to contact the protrusion when the press plate is held at a predetermined position, and the positioning member having a scale that makes it possible to visually check a positional deviation of the press plate in the predetermined direction.

2. The press plate mounting apparatus according to claim 1, wherein the press plate placement portion is provided rotatably about an end portion of the press plate placement portion located toward the plate cylinder holding portion, and allows the press plate to be set on the press plate placement portion with the suction surface facing upward.

3. The press plate mounting apparatus according to claim 2, wherein the press plate placement portion is provided with a floatation restricting member capable of restricting separation of the print face region from the suction surface.

* * * * *